US006177141B1

(12) United States Patent
Billow et al.

(10) Patent No.: US 6,177,141 B1
(45) Date of Patent: Jan. 23, 2001

(54) METHOD FOR COATING A LIQUID COMPOSITION TO A WEB USING A BACKING ROLLER WITH A RELIEVED SURFACE

(75) Inventors: Steven A. Billow, Pittsford; Mark C. Zaretsky, Rochester, both of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/396,098

(22) Filed: Sep. 15, 1999

Related U.S. Application Data

(63) Continuation-in-part of application No. 09/185,045, filed on Nov. 3, 1998, now abandoned.

(51) Int. Cl.[7] ..... B05D 1/26

(52) U.S. Cl. ..... 427/472; 427/420; 427/428

(58) Field of Search ..... 427/420, 428, 427/471, 472, 532; 118/258–262, 409, 419, 621

(56) References Cited

U.S. PATENT DOCUMENTS 3,405,855 * 10/1968 Daly et al. .
4,426,757 * 1/1984 Hourticolon et al. .
4,835,004 * 5/1989 Kawanishi .
4,910,844 * 3/1990 Lioy et al. .
4,914,796 * 4/1990 Lioy et al. .
5,609,923 * 3/1997 Clarke .

FOREIGN PATENT DOCUMENTS 530 752 * 10/1993 (EP) .

* cited by examiner

*Primary Examiner*—Fred J. Parker
(74) *Attorney, Agent, or Firm*—Mark G. Bocchetti

(57) ABSTRACT

A method for coating a liquid composition from an applicator to a moving web supported by a backing roller, characterized by the steps of a) conveying the web in a partial wrap around the backing roller of diameter equal to or greater than 10 cm, the backing roller being provided with a conductive, relieved surface; b) fabricating the relieved surface with a pattern that provides venting, the pattern having a geometry and depth such that the electrostatic force at the coating point does not vary by more than a factor of about ten, the pattern covering at least 30% or more of the width of the web; c) providing an electrostatic field at the coating point; and d) coating at a web speed greater than or equal to 75 meters/minute.

19 Claims, 3 Drawing Sheets

METHOD FOR COATING A LIQUID COMPOSITION TO A WEB USING A BACKING ROLLER WITH A RELIEVED SURFACE

DESCRIPTION

This application is a continuation in part of U.S. patent application Ser. No. 09/185,045 filed Nov. 3, 1998 now abandoned.

FIELD OF THE INVENTION

The invention relates to methods and apparatus for coating a liquid composition onto a moving support web, and more particularly to a method and apparatus for increasing the speed of composition application and for improving the thickness uniformity of applied compositions.

BACKGROUND OF THE INVENTION

In the manufacture of many commercial products, a liquid composition is applied as a coating to a receptor substrate. In many such applications, as in the manufacture of imaging films and papers, the requirements for a real uniformity of coated thickness are highly demanding.

Known coating apparatus typically includes a backing roller around which a continuous web to be coated is wrapped and conveyed at a predetermined conveyance speed. A liquid composition is continuously delivered to and reshaped by an applicator, generally known as a hopper, from a jet flow at the applicator inlet into a broad ribbon of substantially uniform thickness at the applicator outlet from which it is dispensed onto the moving web. Typically, such an applicator is positioned either immediately adjacent to the moving web at a distance of typically less than 1 mm, a transverse, dynamic bead of composition being formed therebetween (bead coating), or above the web at a distance of typically several cm, the composition being allowed to fall as a curtain under gravity into continuous contact with the moving web (curtain coating). A liquid composition may be a single layer or a composite layer consisting of a plurality of coating compositions.

The moving web carries with it a boundary layer of air on the front side (the side to be coated) and the back side (the side facing the backing roller).

To prevent upsets in the coating and resulting coated thickness nonuniformities, each boundary layer must be eliminated before or at the coating point, which elimination becomes more difficult as coating speed is increased.

In all coating systems, there is an upper speed limit for coating at which the boundary layer of air carried on the front side is no longer squeezed out by the advancing composition at the coating point but rather becomes entrained under the composition, disrupting the uniform application thereof to the web and resulting in unacceptable coating uniformity.

It is well known that electrostatic charging of a web and/or coating apparatus can be useful in increasing this limit on coating speed, which process is referred to herein as electrostatic assist. For example, a dielectric web carrying a bound polar charge between opposite surfaces thereof can exhibit increased apparent "wettability" and a consequent increase in acceptable coating speed when conveyed around a grounded coating roller. Means for applying such a charge to a web ahead of the coating point are disclosed, for example, in European Patent No EP 390774; U.S. Pat. Nos. 4,835,004; 5,122,386; 5,295,039; and European Patent Application No. 0 530 752.

Apparatus and methods also have been proposed for maintaining a uniform charge on a web between the charging apparatus and the coating roller. See, for example, U.S. Pat. No. 4,835,004 and European Patent No. 0 530 752 which propose to prevent degradation of charge uniformity by imposing strict environmental controls around the web.

It is also known to apply electrostatic charge at the coating point by electrifying the surface of the coating roller itself. See, for example, U.S. Pat. Nos. 3,335,026; 4,837,045; and 4,864,460.

All of these techniques can be useful in electrostatically assisting the coating of a composition to a web by providing an electrostatic field between the composition and the backing roller at the point of coating. Such an assist acts to cause the composition to be drawn more aggressively toward the backing roller and thus to more forcefully squeeze out the front side boundary layer of air, permitting thereby an increase in coating speed which can be economically beneficial.

As noted above, a moving web also carries a boundary layer of air on its back side or surface as does the backing roller surface prior to engagement with the web. For every conveyance system there exists a speed at which conveyance is limited by back surface air entrainment between the web and the conveying roller. If the surface of the coating roller is smooth and the moving web is conveyed around the roller, then an air film will arise between the web and roller, creating an air bearing between the two surfaces. This air film thickness (h) is a function of several parameters: 1) coating roller radius (R), 2) dynamic air viscosity ($\mu$), 3) web speed ($U_w$), 4) roller speed ($U_R$), and 5) web tension per unit width (T) and is given by the following equation:

$$h = 0.643\, R\left(\frac{6\mu(U_W + U_R)}{T}\right)^{2/3} \qquad \text{Equation 1}$$

[Knox & Sweeney, IECP J., V. 10, 1972].

For a given air viscosity and web tension, the air film thickness will increase with increasing web/roller speed and/or roller diameter. This increase in air film thickness results in decreased contact between the web and roller, with a concomitant loss in traction. If the speed is increased to the point that the air film thickness is of the same order, or larger than, the roughness of either the smooth roller surface or the surface of the web facing the roller, then traction will be lost completely, resulting in slippage of the roller against the web. This loss of traction can result in problems such as cinches, scratches, tension and speed variations. In addition to loss of traction, the entrained air film thickness between the web and roller will result in reduced electric fields in the air gap between the web and the coating liquid, resulting in a significant reduction in the electrostatic assist and an associated occurrence of air entrainment.

It is known to provide means to remove or exhaust the boundary layers of air being carried on the back surface of a web and the surface of a roller when the two come into contact, increasing thereby the tractional contact of the web with the roller. Such means may include, for example, a pressure-loaded nip roller urged toward the conveying roller, the web passing therebetween. However, use of a nip roller may not be particularly desirable, as it adds mechanical complexity to the apparatus, and a face-side nip roller can mar the surface of the web to be coated and can cause electrostatic disturbance of either or both of the web surfaces, resulting in coating non-uniformities.

Such means may also include a relief pattern formed in the surface of the conveying roller into which the back-side boundary layer air may be exhausted from the web and escape. See U.S. Pat. No. 3,405,855 issued Oct. 15, 1968 to Daly et al., for example. In this patent, Daly et al. teach the use of a roller having peripheral venting grooves and supporting land areas to vent air carried by the underside of the traveling web. Another example is provided by U.S. Pat. No. 4,426,757 issued Jan. 24, 1984 to Hourticolon, et al. In this patent, Hourticolon, et al. teach the manufacture and use of a roller having a surface relief consisting of a "finely branched network of compression chambers", allowing the entrained air to be compressed into pockets rather than reducing the web traction. Both of these patents deal with purely conveyance roller issues and neither patent addresses the issue of electrostatic assist with such a roller surface pattern. It is not obvious that these roller surface patterns would perform well during an electrostatically assisted coating process, because these relief patterns will produce electrostatic field variations at the liquid-air interface of the coating composition. As shown in this invention, the resulting variations in the electrostatic force felt by the coating fluid can vary by more than a factor of ten. This local reduction in electrostatic force over the relieved surfaces will allow air entrainment at the front side (between the coating fluid and the web) to occur at lower speeds compared to those portions of the web with intimate contact between the roller surface and the back side of the web. Therefore, at intermediate speeds, it has been observed to obtain good coating over the portions of the web in intimate contact with the backing roller and air entrainment between the web and the coating solution over the relieved portions of the roll whereas at higher speeds, air entrainment is observed across the entire web.

As an example, using equation 1 and the parameter values given in the example by Hourticoulon (7 cm roller diameter, 380 m/min. web speed, and 15 kg/m web tension) yields an air film thickness of 10 $\mu$m. This film thickness is smaller than the stated depths of the compression chambers of 30–80 $\mu$m, and therefore a smooth roller under the same operating conditions would be expected to produce higher and more uniform electrostatic assist levels than a roller having the "finely branched network of compression chambers" described by Hourticoulon, et al. Similarly, the groove depths described by Daly, et al. are greater than 500 $\mu$m, leading to the same unfavorable comparison with smooth rollers regarding electrostatic assist level and uniformity. Current state-of-the-art practice, therefore, is the use of a smooth backing roller when practicing electrostatically assisted coating. The use of a roller having a relieved surface pattern has been limited to use without electrostatic assist because of the above problems.

It has been found that the current practice of using a smooth backing roller while practicing electrostatically-assisted coating performs satisfactorily at relatively low web speeds, such as less than 75 meters/minute. However, at higher web speeds over backing rollers with diameters greater than or equal to about 10 cm, a thin air film is captured between the web and the smooth backing roller. This air film increases in thickness as web speed increases. Moreover, in contrast to the expectation from equation 1, it is observed on actual coating machines that this thickness is not constant but highly variable due to the numerous sources of variation present in the coating environment, and contact between the roller and the web may be intermittent, causing pockets of air to be entrained between the web and roller. For coating systems employing electrostatic assist, as the web is lifted off the backing roller, capacitance relationships among the backing roller, the web, and the coating applicator can change significantly, reducing locally the magnitude of electrostatic assist and thus permitting onset of air entrainment failure at the coating nip. These intermittent pockets of air will result in a reduction in electrostatic force that is larger than the reduction expected due to the uniform air film thickness predicted from equation 1.

SUMMARY OF THE INVENTION

It is a principal object of the invention to increase the electrostatically-assisted coating speed of a coating system.

It is a further object of the invention to maximize the electrostatically-assisted coating speed of a coating system.

It is a still further object of the invention to provide an improved web coating method whereby a predetermined electrostatic field between a liquid coating composition and an improved coating backing roller assists in providing a coating having acceptable thickness uniformity.

It is a further object of the invention to provide an improved web coating method whereby webs may be coated to an acceptable level of uniformity at high coating speeds.

It is a still further object of the invention to provide an improved, more operationally robust web coating method that is more tolerant of other operational variability.

We have shown that it is desirable to use a relieved backing roller when practicing electrostatically-assisted coating at speeds greater than 75 meters/minute when the backing roller diameter is greater than or equal to about 10 cm. This practice limits the loss of electrostatic force felt by the coating fluid and allows higher coating speeds before suffering face side air entrainment. Moreover, the variation in the capacitance between the surface of the backing roller and the coating fluid when using a relieved backing roller can be significantly reduced compared to the use of a smooth backing roller.

Attempting to accomplish these same results by an increase in linear web tension can cause excessive strain on rollers and other machine components. Furthermore, it is often desirable to maintain corrugation in the web over portions of the web path; increasing tension will make this corrugation difficult or impossible to maintain. Likewise, a smaller roller diameter is known to increase the conveyance speed at which this separation between the web and the backing roller can occur. This has inherent disadvantages as well. Current coating station designs require various hardware components to be placed within close proximity of the roller surface, making it desirable to have a larger coating roller circumference. Smaller rollers also have less stiffness and as a result are poorer at resisting bending and deflection under normal tension loads. Decreasing the roller diameter also increases the angular speed of the roller, thus requiring better vibration characteristics at higher frequencies. It is therefore desirable to prevent separation of the web from the backing roller at typical tension loads (0.3 Newtons per centimeter to 4 Newtons per centimeter) and with typical roller diameters (greater than or equal to about 10 cm).

The present invention is defined by the claims. The apparatus and method of the invention are useful in providing coated substrates having a high level of coated layer uniformity, manufactured at higher substrate coating speeds than would be possible without the invention.

Briefly described, our invention includes a method for coating a liquid composition to a moving web, characterized by the steps of a) providing a web conveyance path including a coating backing roller having a diameter greater than or equal to about 10 cm and having a conductive, relieved surface pattern; b) said relieved surface pattern having a geometry and depth such that the electrostatic force at the coating point does not vary by more than a factor of about ten, said pattern covering at least 30% or more of the width of the web, preferably covering the center 30% portion of the width of the web; c) providing an electrostatic field at the coating point between the coating applicator and the backing roller; and d) dispensing the liquid composition from the applicator onto the surface of a web moving at a speed greater than or equal to 75 meters/minute, the electrostatic field extending through the web to engender an electrostatic "pressure" urging the liquid composition toward the front surface of the substrate at the coating point to exclude the front side air boundary layer, and the relieved surface of the backing roller dissipating the back side air boundary layer.

In a preferred method and apparatus in accordance with the invention, a substantially dielectric web to be coated either with a single or multiple coatings of a gelatin-based aqueous emulsion, for example, a web formed from polyethylene terephthalate, is first passed through means for dissipating all surface charges on the web. Preferably such means is disposed in the web conveyance path of a coating machine a short distance ahead of the point of entrance of the web onto the coating backing roller. An example of a suitable means for dissipating charges is a set of ionizers similar to that disclosed in U.S. Pat. No. 3,730,753 issued May 1, 1973 to Kerr, hereby incorporated by reference, wherein the web is exposed sequentially to one or more high positive charges and high negative charges to "flood" pre-existing charge variations on the web and is then discharged. Preferably, the web is also conditioned for coating by removal of residual free charge by treatment, for example, in accordance with the disclosure of U.S. Pat. No. 5,432,454, hereby incorporated by reference, as described in detail hereinbelow.

After being electrically neutralized, the web is entered onto an electrically-isolated backing roller at a coating station wherein a coating applicator, for example, a hopper, provides a ribbon of liquid composition for coating. The applicator is maintained at ground potential, and the surface of the roller is maintained at a predetermined DC potential, preferably greater than about 300 volts either positive or negative, with respect to ground, creating an electrostatic field around the roller. The electrostatic field engenders an electrostatic force that acts to impel the emulsion against the web, squeezing out the boundary layer of air being carried on the front surface of the web.

Means is also provided to exhaust the boundary layer of air being carried on the back surface of the web to minimize the large capacitance variations caused by intermittent pockets of air between the web and the backing roller observed when conveying over a smooth backing roller at high speed. Such means may include, for example, a pressure-loaded nip roller urged toward the backing roller ahead of the coating point, the web passing therebetween. Preferably, such means includes a relief pattern formed in the surface of the backing roller into which boundary layer air may be exhausted from the web and escape.

The practical result of accommodating both front side and back side boundary air layers is an increase in the maximum coating speed achievable without onset of air entrainment at the coating point or disengagement of the web from the backing roller surface.

BRIEF DESCRIPTION OF THE DRAWINGS

The foregoing and other objectives, features, and advantages of the invention will be apparent from the following more particular description, including the presently preferred embodiment of the invention, as illustrated in the accompanying drawings in which.

DETAILED DESCRIPTION OF THE INVENTION

Figure 1:
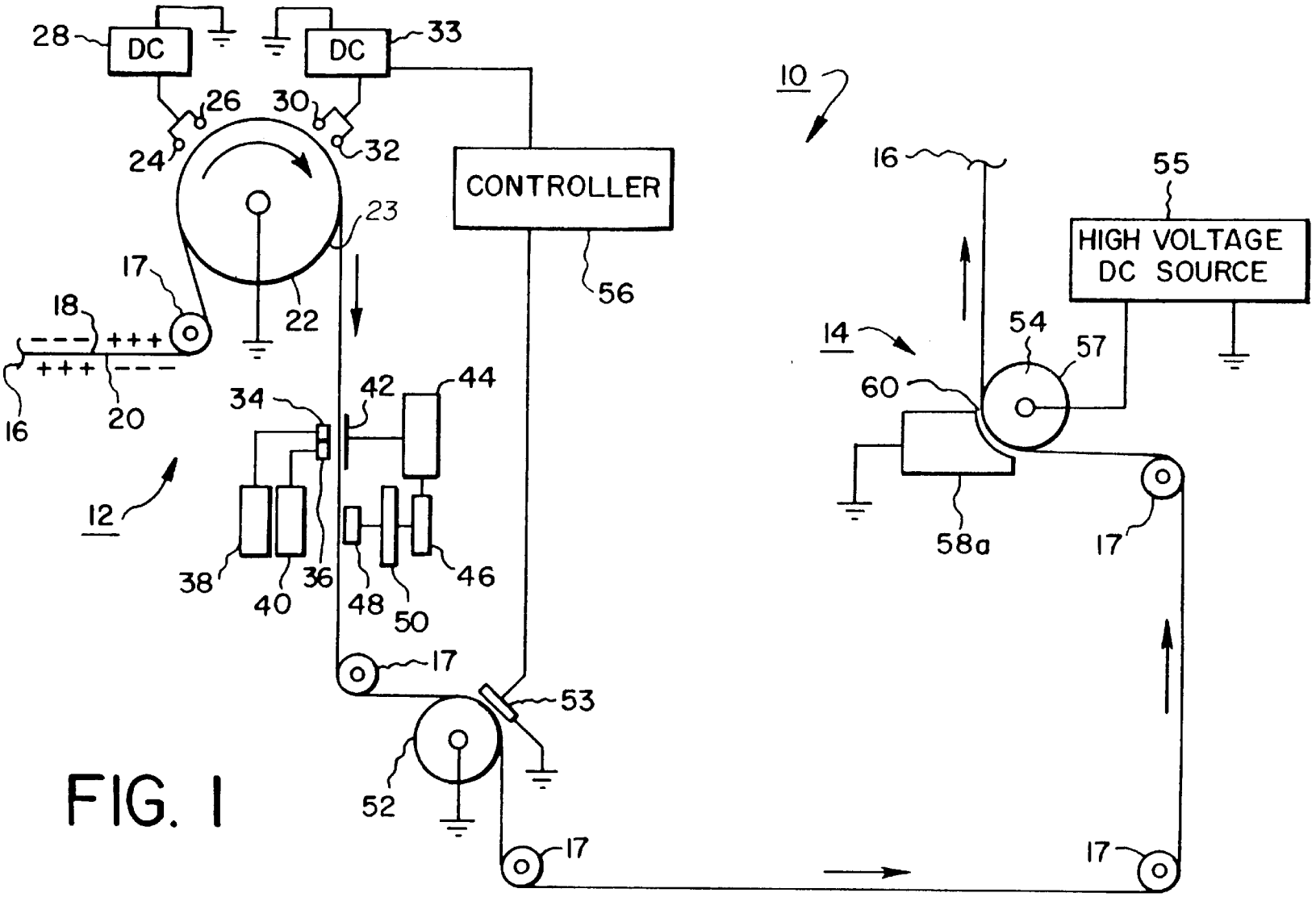
FIG. 1 is a schematic cross-sectional view of a versatile apparatus for providing electrostatic assist in a plurality of ways to the bead coating of a web being conveyed around a relieved-surface backing roller in accordance with the invention.
Figure 2:
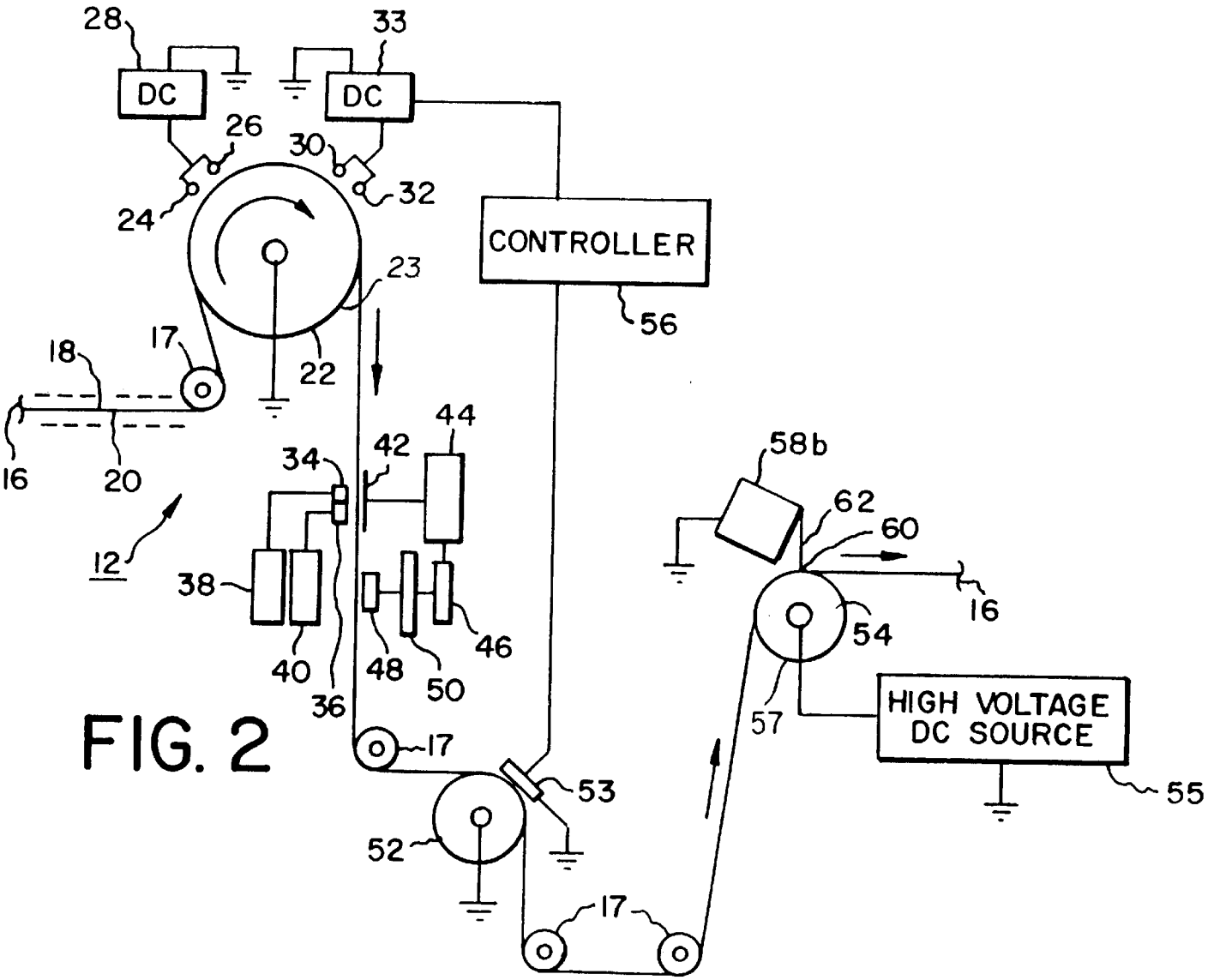
FIG. 2 is a schematic view like that in FIG. 1, shown for curtain coating of the web.

Referring to FIGS. 1 and 2, a versatile electrostatic coating assist apparatus 10 for coating a liquid composition to a web in accordance with the invention includes a web charge-modification section 12 and an electrifiable coating section 14 for bead (FIG. 1) or curtain (FIG. 2) coating of the web. Other known coating applicators, for example, an extrusion hopper or a slide-extrusion hopper, may also be readily adapted for use in accordance with the invention.

Apparatus 10 is versatile in that electrostatic coating assist may be provided by section 12 without electrification of section 14, or by electrification of section 14 without installation or use of section 12, or preferably by use of sections 12 and 14 together, as described below. The common element among these methods and apparatus configurations is that a voltage differential is created between the liquid composition and the backing roller at the coating point, preferably a voltage differential greater than at least about 300 volts. This may be achieved, although not necessarily with equal quality results, by either a) electrifying the web ahead of the coating point so that the web carries a charge into section 14; or b) by electrifying the coating apparatus in section 14 to provide the desired field at the coating point; or, c) by a combination of a) and b). In a preferred embodiment, described in detail below, the web is first electrified and then completely neutralized in section 12, so that the field providing electrostatic assist for coating derives only from the electrification in section 14.

In a presently preferred embodiment, a continuous web 16 having first and second surfaces 18,20, is supplied to section 12 from a conventional unwinding and conveyance apparatus (not shown) and may be conveyed conventionally through the apparatus on generic rollers 17. Web 16 may be formed of any substantially non-conductive material including, but not limited to, plastic film, paper, resin-coated paper, and synthetic paper. Examples of the material of the plastic film are polyolefins such as polyethylene and polypropylene; vinyl copolymers such as polyvinyl acetate, polyvinyl chloride, and polystyrene; polyamide such as 6,6-nylon and 6-nylon; polyesters such as polyethylene terephthalate, and polyethylene-2 and -6 naphthalate; polycarbonate; and cellulose acetates such as cellulose diacetate and cellulose triacetate. The web may carry one or more coats of subbing material on one or both surfaces. The resin employed for resin-coated paper is typically a polyolefin such as polyethylene.

Web 16 may have patches of electrostatic charges disposed randomly over one or both surfaces 18,20. In Section 12, charges on the web are adjusted. When section 14 is not electrified, the web in section 12 is provided with a residual charge of at least about 300 volts as measured by induction probe 53 at the exit of section 12. Various methods and apparatus known in the art, including but not limited to those disclosed in the patents recited hereinabove, may be suitable for charge modification in section 12 in accordance with the invention.

In an embodiment presently preferred for both plastic and paper webs, both sections 12 and 14 are provided, section 12 being used as follows. Web 16 is wrapped and conveyed around a grounded, conductive backing roller 22 with web surface 20 in intimate contact with the conductive surface 23 of roller 22. Web surface 18 is exposed to negatively charged electrodes 24,26 which "flood" a large amount of negatively charged particles onto surface 18. Electrodes 24,26 may be electrically connected to the negative terminal of an adjustable 0–20 kV, 0–15 mA source 28 of DC potential. Grounded roller 22 acts as a counter electrode for electrodes 24,26.

As web 16 is advanced along roller 22, it moves beneath electrodes 30,32 which may be electrically connected to the positive terminal of a DC potential source 33 similar to source 28. Electrodes 30,32 deposit a large amount of positively charged particles onto web surface 18 which neutralize the negative charge previously imparted to this surface by electrodes 24,26. Grounded roller 22 functions as a counter electrode for electrodes 30,32.

Web 16 is further conveyed about grounded roller 52 so that web surface 20 is in intimate contact with roller 52, the opposing web surface 18 being exposed to an induction probe 53 of a feedback control system comprising probe 53 and controller 56, which controller is responsive to the level of charge sensed by probe 53 and may be programmed to automatically adjust the level of charge applied by DC source 33 to electrodes 30,32 to control the steady-state residual charge on surface 18 at any desired value. When section 14 is being electrified in addition to section 12 in accordance with the preferred embodiment of the invention, controller 53 is programmed to provide a residual voltage at probe 53 near or at zero.

The just-described electrostatic web treatment typically is sufficient to completely discharge all charges on surface 18 of the web and some of the charge on surface 20. However, some webs may retain some residual charge on surface 20 which may also be removed.

After leaving roller 22, web 16 may be conveyed past two fixed voltage or fixed DC current ionizers 34,36 which are mounted near and facing surface 20 of web 16 on a free span of travel. The ionizers 34,36 are mounted so that the central axis of each ionizer is oriented parallel to the web in the transverse direction of the web. Each ionizer is electrically connected to a separate DC high voltage power supply 38,40. A conductive plate 42 which is electrically isolated from ground is positioned opposite ionizers 34,36 and facing surface 18 of web 16. Plate 42 can be of various shapes, designs, constructions, or materials, including both solid materials and screens, but plate 42 must incorporate at least a layer of conductive material to act as an equipotential surface to attract charge from ionizers 34,36. A controllable bipolar high voltage source 44 is electrically coupled to plate 42 to deliver voltage to the plate over a wide range of positive and negative voltages (±5 kV). A feedback control system 46 may have a sensor or sensor array 48 responsive to the mean charge density residual on the web after treatment by the ionizers. Source 44 may be adjusted manually to adjust the voltage level on plate 42 so that the plate voltage increases in the same polarity as a direct function of the residual charge density on the web; preferably, such adjustment is controlled automatically by electronic controller 50 to minimize the steady-state residual free charge on the web, preferably near or at zero.

As shown in FIGS. 1 and 2, in section 14 web 16 is entered upon and wrapped partially around a backing roller 54, the angle of wrap including coating point 60. Roller 54 is preferably electrically isolated and may be electrically connected to a high voltage DC source 55 to place a high potential on the surface 57 of backing roller 54, for example, 300 V, creating a standing electric field around roller 54. Coating applicator 58 (either bead coating applicator **58*a* in FIG. 1 or curtain coating applicator 58*b* in FIG. 2**) is electrically grounded.

It is known in the coating art to relieve air pressure under a web being conveyed around a roller, caused by the web's back surface boundary air layer, by providing a patterned relief in the surface of the roller. Such patterning can be very effective in allowing boundary layer air to escape either laterally or, more commonly, longitudinally of the web.

As is known in the art, relief patterning may take any of several forms. For example, a roller surface may be formed in a random pattern (see U.S. Pat. No. 4,426,757) or may be wound with spaced-apart turnings of wire (see U.S. Pat. No. 5,431,321). Such random pattern may be etched, machined, abraded, or shot-blasted to provide surface relief, which relief may comprise a finely branched collection of chambers and troughs 61 in the roller surface with adjacent plateau-like surfaces 63 presenting a generally cylindrical land area for supporting the web, as shown in FIG. 4 and taught by Hourticolon, et al. By plateau-like surface it is meant a surface whose topography is relatively flat as compared to the depth of the chambers and troughs. More commonly, a roller is provided with a plurality of radial circumferential grooves, referred to herein as microgrooves, as shown in FIG. 3, for example, approximately 10% to 40% of the roller surface may consist of grooves 0.5 mm to 2.4 mm in depth, 0.5 mm to 2.3 mm in width, and arranged from 5 mm to 15 mm apart.

Figure 3:
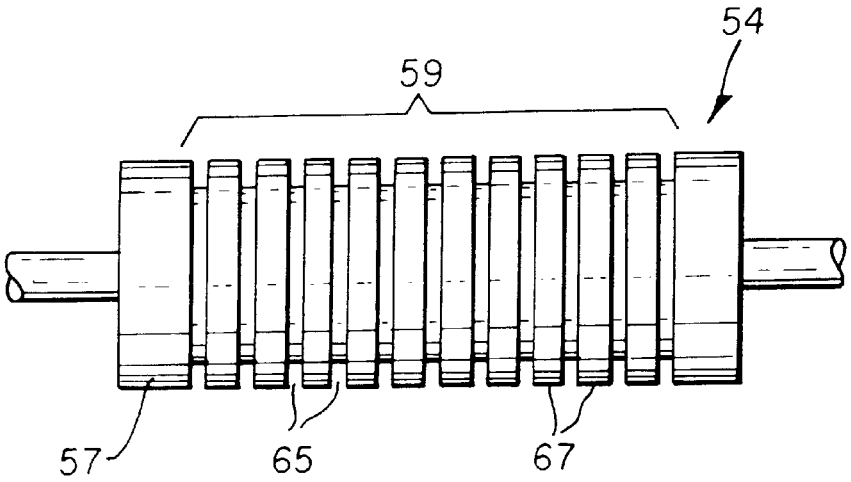
FIG. 3 is a cross-sectional view of a first embodiment of a relieved backing roller in accordance with the invention.
Figure 4:
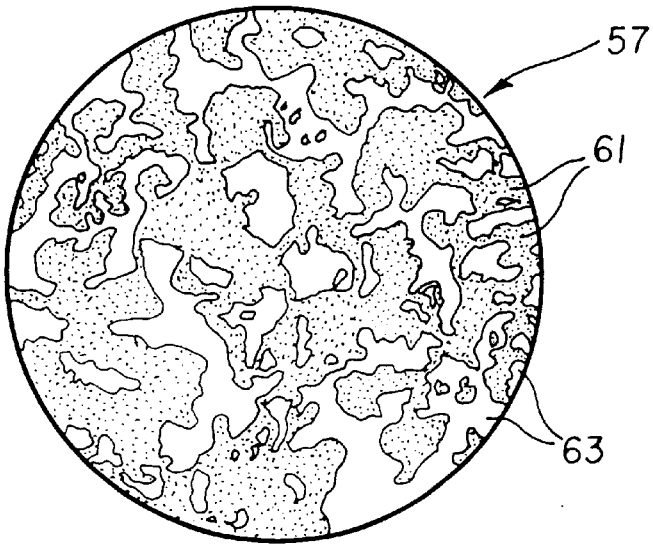
FIG. 4 is a plan view of a portion of the surface of a second embodiment of a relieved backing roller in accordance with the invention.

In methods and apparatus in accordance with the present invention, coating backing roller 54 is provided with a relieved pattern 59 in the surface 57 thereof, which pattern may be a random pattern such as is shown in FIG. 4, and preferably is in the form of a plurality of generally uniformly aligned circumferential grooves 65 and ridges 67 in the surface 57 of the roller as shown in FIG. 3, the ridges presenting a generally cylindrical closely axially spaced land area for supporting the web and permitting the web to bridge the grooves, the grooves being vented to ambient atmosphere at the oncoming and off-running sides of the area of web wrap of the roller. Such grooves are similar to those described in U.S. Pat. No. 3,405,855 which is hereby incorporated by reference. Other groove widths, depths, and spacings may also be useful in practicing methods of the invention. A pattern may be deemed acceptable if it 1) provides adequate venting such that good contact between the web and backing roller is maintained at the desired coating speed as determined by comparison of web speed and roller surface speed and verifying they are in reasonable agreement; 2) is of a geometry and depth such that the electrostatic force at the coating point does not vary by more than a factor of about ten between the grooves 65 and ridges 67 (as can be calculated with an electrostatic field solver employing such methods as boundary element, finite element or finite difference); and 3) covers 30 percent or more of the width of the web on the roller, preferably covering the center 30% portion of the width of the web. For the purposes of this invention, the electrostatic force variation was calculated using a finite difference model. The model geometry has the coating fluid as an upper electrode at ground potential, a 30 $\mu$m thick air gap between this electrode and the web, and then the web substrate to be coated with its associated thickness, permittivity and incoming surface charges. Below the web substrate lies the coating roller surface, taken to be an equipotential at either ground or some non-zero potential. Between the web and the relieved portions of the roller surface is an air gap of a thickness consistent with the depth of surface relief pattern.

Thus, the electric field around roller 54 creates an electrostatic attractive force which acts to draw the curtain or bead 62 of liquid composition aggressively against the surface 18 of web 16, thereby increasing the upper limit of coating speed without air entrainment into the liquid composition being applied. Simultaneously, the relieved pattern 59 in surface 57 allows the escape of air being carried as a boundary layer on surface 20 of web 16, thereby enhancing traction of the web on the roller and preventing the onset of web lifting from the roller surface, thereby minimizing any reduction in the electrostatic force felt by the fluid and maximizing its benefit. If the electrostatic force variation at the coating fluid varies by more than a factor of about ten the maximum coating speed achievable by this patterned roller when using this electrostatic assist process will be substantially comparable to or less than the maximum coating speed achievable by a smooth roller.

Example:

An aqueous composition having a viscosity of 21 cP, containing about 12% gelatin and a surfactant, was curtain coated to a web of gelatin-subbed polyethylene terephthalate 0.1 mm thick being conveyed on a backing roller with a diameter of 20 cm. The web surface charges were neutralized prior to the coating step. The backing roller was electrically isolated and connected to a high voltage power supply. The backing roller had a smooth surface for trials 1 and 2 (Roller A) and had a relieved surface for trials 3, 4, 5 and 6. The relieved surface covered at least 30% of the width of the web and consisted of circumferential grooves. For trials 3 and 4 (using Roller B) the relieved surface had a nominal groove depth (in the radial dimension) of 0.15 mm, a nominal width of 0.43 mm and a nominal pitch of 1 groove per mm. Using the method and parameters detailed earlier, the electrostatic force variation for this surface pattern was calculated to be 4.3. For trials 5 and 6 (using Roller C) the relieved surface had a nominal groove depth (in the radial dimension) of 0.35 mm, a nominal width of 0.70 mm and a nominal pitch of 0.7 grooves per mm. Using the method and parameters detailed earlier, the electrostatic force variation for this surface pattern was calculated to be 15.0. The flow rate was 2 cc/cm/sec, the curtain height was 25 cm, and the application angle was +35° (forward) from top-dead-center.

For trials 1, 3 and 5 the backing roller was operated at 0V, no electrostatic assist was provided. For trials 2, 4 and 6 the backing roller was operated at 800V to provide an electrostatic assist. For each test condition the maximum coating speed was established at which air entrainment under the impinging curtain began. For each roller surface pattern the speed increase due to the addition of electrostatic assist was calculated and tabulated in Table 1. As shown in the table, the speed increase is highest for Roller B and lowest for Roller C, with the Roller A results in between.

| Trial | Roller | Voltage (V) | Speed Increase (m/min.) Due To Electrostatic Assist |
|---|---|---|---|
| 1 | A | 0 | 117 |
| 2 | A | 800 | |
| 3 | B | 0 | 144 |
| 4 | B | 800 | |
| 5 | C | 0 | 75 |
| 6 | C | 800 | |

The many features and advantages of the invention are apparent from the detailed specification and thus it is intended by the appended claims to cover all such features and advantages which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

PARTS LIST

10 first embodiment
12 charge-modification section
14 electrifiable coating section
16 continuous web
17 web conveyance rollers
18 first web surface
20 second web surface
22 conductive backing roller in 12
23 conductive surface of 22
24 first negative electrode
26 second negative electrode
28 DC source to drive 24,26
30 first positive electrode
32 second positive electrode
33 DC source to drive 30,32
34 first DC ionizer
36 second DC ionizer
38 power supply for 34
40 power supply for 36
42 conductive plate
44 bipolar high voltage source
46 feedback control system
48 sensor
50 electronic controller
52 grounded roller
53 induction probe
54 patterned-surface coating backing roller
55 high voltage DC source
56 controller
57 conductive surface of 54
58 coating applicator
59 relieved pattern in 57
60 coating point
61 chambers and troughs
62 curtain of coating composition
63 plateau-like surfaces
65 grooves
67 ridges

What is claimed is:

1. A method for coating a liquid composition from an applicator to a first surface of a moving plastic web having opposite first and second surfaces, the web being conveyed along a path through an apparatus for coating against a backing roller at a coating point, comprising the steps of:

a) wrapping said web about a portion said second surface thereof in a partial wrap around said backing roller of diameter equal to or greater than 10 cm, said backing roller being provided with a conductive, relieved surface, said relieved surface having a pattern that provides venting of entrained air, said pattern having a geometry and depth such that the electrostatic force at said coating point does not vary by more than a factor of about ten, said pattern covering at least 30% or more of the width of the web;

b) providing an electrostatic field at said coating point; and c) applying the liquid composition to the first surface at the coating point while maintaining a web speed greater than or equal to 75 meters/minute.

2. A method in accordance with claim 1 wherein said electrostatic field has a strength equivalent to that produced by applying a voltage differential of at least about 300 V between said backing roller and said applicator.

3. A method in accordance with claim 1 wherein said providing step is carried out with the assistance of a first negatively-charged electrode and a second positively-charged electrode, each being spaced apart from a grounding means, and comprising the step of passing said web between said grounding means and said first and second electrodes to alter electrostatic charges on said first surface of said web.

4. A method in accordance with claim 3 wherein said grounding means is a grounded conductive roller.

5. A method in accordance with claim 3 wherein said providing step is carried out with the further assistance of first and second DC ionizers of opposite polarity, each being spaced apart from a conductive means, and comprising the step of passing the web between said conductive means and said first and second DC ionizers to alter electrostatic charges on said second surface of said web.

6. A method in accordance with claim 5 wherein said electrostatic charge on said web after said electrode and ionizer treatments is substantially zero.

7. A method in accordance with claim 5 wherein said conductive means is maintained at a voltage other than zero by a voltage control means electrically connected to said conductive means.

8. A method in accordance with claim 7 wherein said voltage control means includes a bipolar high voltage source (±5 kV) and a charge sensor connected to said source.

9. A method in accordance with claim 1 wherein said coating applicator is selected from the group consisting of bead coating applicator, curtain coating applicator, extrusion coating applicator, and slide-extrusion coating applicator.

10. A method in accordance with claim 1 wherein said coating backing roller is maintained at a voltage other than zero by a voltage control means electrically connected to said roller and wherein said coating applicator is grounded.

11. A method in accordance with claim 1 wherein said coating applicator is maintained at a voltage other than zero by a voltage control means electrically connected to said coating applicator and wherein said coating backing roller is grounded.

12. A method in accordance with claim 1 wherein said relieved surface composes a plurality of generally uniformly aligned circumferential grooves and ridges, said ridges presenting a generally cylindrical closely axially spaced land area for supporting the web and permitting the web to bridge the grooves, said grooves being vented to ambient atmosphere at the oncoming and off-running sides of the area of web wrap of said roller.

13. A method in accordance with claim 1 wherein said relieved surface comprises a branched collection of chambers and troughs in said roller surface with adjacent plateau surfaces presenting a generally cylindrical land area for supporting the web.

14. A method for coating a liquid composition from an applicator to a fit surface of a web, the web being conveyed along a path through an apparatus for coating against a backing roller at a coating point, comprising the steps of:

a) providing said backing roller with a diameter greater than or equal to 10 cm and a conductive, relieved surface for supporting a second surface of said web;

b) fabricating said relieved surface with a pattern that provides venting of entrained air, said pattern having a geometry and depth such that the electrostatic force at said coating point does not vary by more than a factor of about ten, said pattern covering at least 30% or more of the width of the web;

c) neutralizing electrostatic charges on said first and second surfaces of said web upstream of said coating point;

d) applying an electrostatic force to the composition at the coating point; and e) coating the web at the coating point at a web speed greater than or equal to 75 meters/minute.

15. A method in accordance with claim 14 wherein said neutralizing step further comprises the steps of applying and removing negative and positive electrostatic charges.

16. A method in accordance with claim 14 wherein said applying step further comprises the step of establishing a voltage differential between said backing roller and said applicator.

17. A method in accordance with claim 14 wherein one of said backing roller and said applicator is maintained at electrical ground and the other of said backing roller and said applicator is maintained at a predetermined voltage of either polarity.

18. A method for coating a liquid composition from an applicator to a first surface of a moving paper web having opposite first and second surfaces, the web being conveyed along a path through an apparatus for coating against a backing roller at a coating point, comprising the steps of:

a) leading said web on said second surface thereof in a partial wrap around said backing roller of diameter equal to or greater than 10 cm, said backing roller being provided with a conductive, relieved surface;

b) fabricating said relieved surface with a pattern that provides venting of entrained air, said pattern having a geometry and depth such that the electrostatic force at said coating point does not vary by more than a factor of about ten, said pattern covering at least 30% or more of the width of the web;

c) providing an electrostatic field at said coating point with the assistance of a first negatively-charged electrode and a second positively-charged electrode, each being spaced apart from a grounding means, and comprising the step of passing said web between said grounding means and said first and second electrodes to alter electrostatic charges on said first surface of said web, and with the further assistance of first and second DC ionizers of opposite polarity, each being spaced apart from a conductive means, and comprising the step of passing the web between said conductive means and said first and second DC ionizers to alter electrostatic charges on said second surface of said web; and with the further assistance of a power source connected between said backing roller and said coating applicator; and d) coating the web at the coating point at a web speed greater than or equal to 75 meters/minute.

19. A method in accordance with claim 18 wherein said electrostatic field has a strength equivalent to that produced by applying a voltage differential of at least about 300 V between said backing roller and said applicator.

* * * * *